United States Patent [19]

Shadid

[11] 4,278,241

[45] Jul. 14, 1981

[54] TOP CONE COOLING SYSTEM FOR BASIC OXYGEN FURNACE

[75] Inventor: Fahim E. Shadid, Downers Grove, Ill.

[73] Assignee: Chicago Bridge & Iron Company, Oak Brook, Ill.

[21] Appl. No.: 169,978

[22] Filed: Jul. 18, 1980

[51] Int. Cl.[3] ..... C21C 5/42

[52] U.S. Cl. ..... 266/241; 266/243

[58] Field of Search ..... 266/241, 243

[56] References Cited

U.S. PATENT DOCUMENTS

| | | | |
|---|---|---|---|
| 3,719,355 | 3/1973 | Suette | 266/241 |
| 3,843,106 | 10/1974 | Nanjyo | 266/241 |
| 4,098,497 | 7/1978 | Weihbold | 266/241 |

*Primary Examiner*—P. D. Rosenberg

*Attorney, Agent, or Firm*—Merriam, Marshall & Bicknell

[57] ABSTRACT

An improved basic oxygen furnace with an internally insulated metal shell having a bottom, wall and top conical portion, with the improvement comprising a plurality of cooling liquid metal walled heat-exchange passages, adjacent the top conical portion exterior surface, substantially aligned like element lines of a conical surface; a header to supply a cooling liquid so that it flows upwardly in all of the passages; and a header to withdraw cooling liquid, from the upper end of the passages, away from the surface which is being cooled.

11 Claims, 8 Drawing Figures

TOP CONE COOLING SYSTEM FOR BASIC OXYGEN FURNACE

This invention relates to basic oxygen furnaces. More particularly, this invention is concerned with improvements in the apparatus for cooling the top cone of basic oxygen furnaces.

BACKGROUND OF THE INVENTION

The basic oxygen furnace used in the steel industry usually has a rounded metal bottom, cylindrical metal side and a metal conical top portion with internal brick lining.

Because of the high temperatures involved, particularly at the vessel upper conical portion, it is necessary to provide a cooling system to prevent the conical portion from overheating and failing. See for example U.S. Pat. Nos. 3,304,075; 3,687,436; 3,719,355; 3,799,524; 3,817,504; and 3,895,783. Water is the usual cooling liquid although other liquids could be employed.

Existing cooling systems utilize flow passages whereby the coolant (water) flows upward from a lower header to an upper header and then back to a lower header. The upward and downward flow is against the cone shell. In this case, when the water flows downward against the shell, steam which may be created will want to move counter to the flow direction. This may block the flow.

SUMMARY OF THE INVENTION

This invention provides an improvement in a molten metal refining vessel comprising an internally insulated metal shell which has a bottom, wall and top conical portion, with said improvement comprising a plurality of cooling liquid metal walled heat-exchange passages, adjacent the top conical portion exterior surface, substantially aligned like element lines of a conical surface, means to supply a cooling liquid so that it flows upwardly in all of the passages; and means to withdraw cooling liquid, from the upper end of the passages, away from the surface which is being cooled.

By having the cooling liquid (water) flow upwardly through all of the passages, any vapor which is formed is carried along in concurrent upward flow with the liquid since the vapor will be lighter than the liquid. This would not be the case if the flow in some passages was downward in reverse direction because the lighter vapor would seek to bubble upwardly and may cause blockage of the downward flow of liquid in those passages. This could result in hot spots of the vessel shell conical top portion.

The means to supply cooling liquid to the passages desirably supplies the cooling liquid to the lower end of the passages. In addition, the means for withdrawing cooling liquid from the upper end of the passages should also prevent it from flowing downwardly in the passages along the cone shell.

In a more specific embodiment of the improvement, the passage lower ends communicate with an inlet header; the means to supply a cooling liquid communicates with the inlet header; the passage upper ends communicate with an outlet header; and the means to withdraw cooling fluid communicates with the outlet header.

Desirably, the passages are arranged in a plurality of side-by-side assemblies. The number of assemblies used will depend on the required coolant flow rate. Each assembly can comprise a group of adjacent passages with an inlet header communicating with the passage lower ends and with an outlet header communicating with the passage upper ends. The means to supply a cooling liquid can communicate with the inlet header of a first assembly and the means to withdraw cooling liquid can communicate with the outlet header of a terminal assembly. Each pair of adjacent assemblies can have a liquid conduit or pipe communicating with the outlet header of the upstream assembly, and with the inlet header of the downstream assembly, of the pair. Furthermore, the liquid conduit or pipe can be spaced above, so as to be out of contact with, the vessel conical top surface, and the metal walls of the passages can be in contact with the vessel conical top surface. By having the liquid conduit or pipe above the conical top surface or spaced away from the surface being cooled, the insulating air space therebetween keeps the liquid conduit or pipe at a lower temperature. This helps to cool the cooling liquid and condense vapor, such as steam, in the liquid conduit or pipe.

The passages are readily formed by placing structural members, such as angles or channels, in side-by-side position welded along their longitudinal edges to the conical top surface. Thus, the above scheme provides only unidirectional upward flow against the cone surface. This is the same as the natural flow of the steam which would insure that no blockage of the flow will occur. The coolant returns through the pipe from the upper header to the lower header as mentioned above.

DETAILED DESCRIPTION OF THE DRAWINGS

So far as it is practical and convenient, and maintains clarity of the disclosure, the same or similar parts or elements in the various views of the drawings will be identified by the same numbers.

Figure 1:
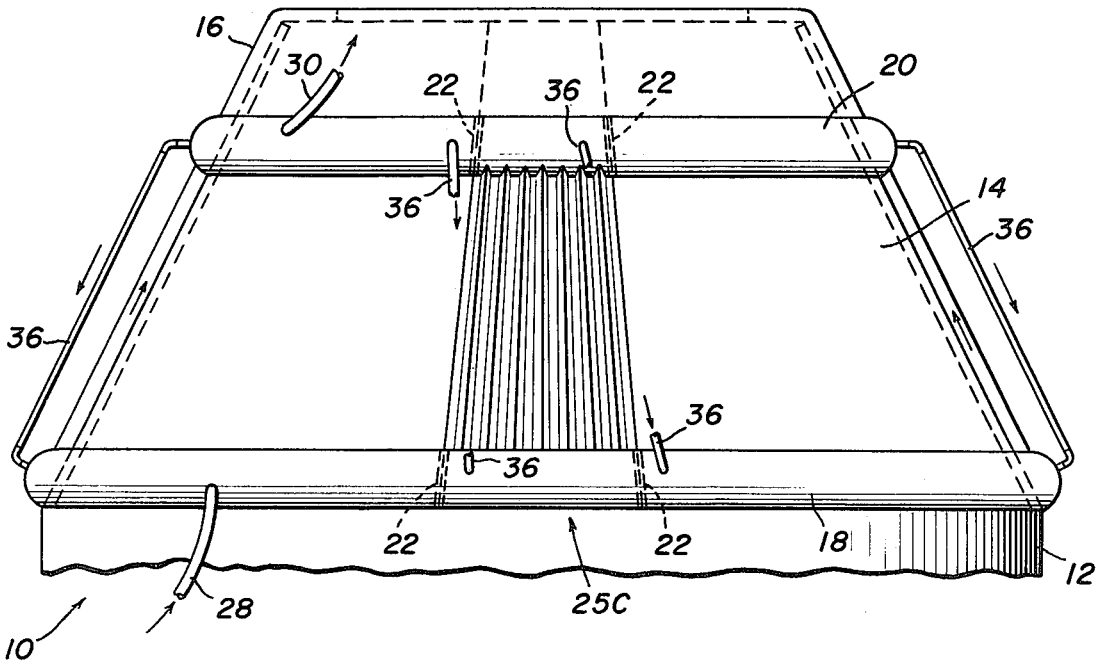
FIG. 1 is an elevational view of the top conical portion of a basic oxygen furnace having metal walled cooling liquid passages attached thereto and means to supply cooling liquid to the lower ends of the passages and means to remove the liquid from the upper ends of the passages.
Figure 2:
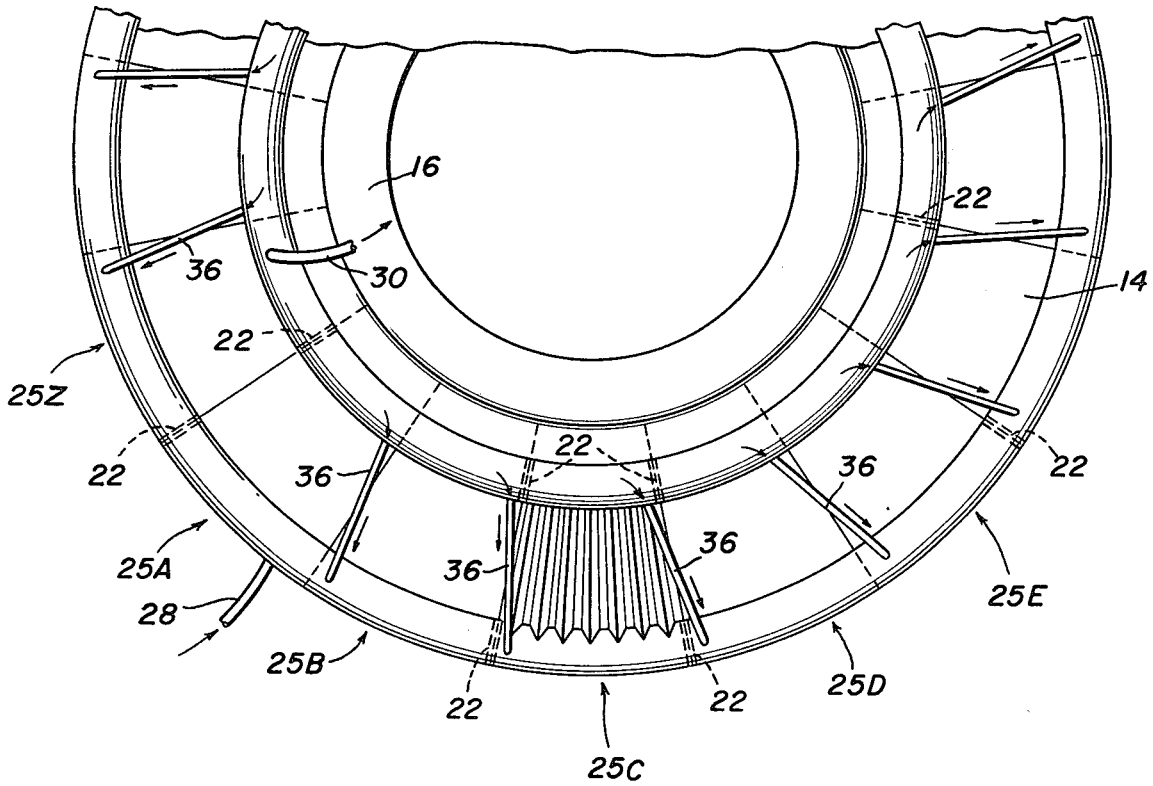
FIG. 2 is a partial plan view of the vessel shown in FIG. 1.

With reference to FIGS. 1 and 2, the molten metal refining vessel 10, of conventional construction, has a bottom (not shown), wall 12 and a conical top portion 14. The inside of vessel 10 is lined with brick insulation which is not shown. Lip ring 16 is mounted on the top outer edge of the vessel mouth.

A lower header ring 18, made of a half pipe, extends around the lower end of top conical portion 14. An upper header ring 20, also made of a half pipe, extends around the upper end of top conical portion 14. Spaced-apart partitions 22 are positioned inside of the lower header ring 18 and the upper header ring 20. The partitions are positioned so as to divide the header rings into sixteen segments or section 25A, 25B, etc. More or less segments can be used depending on the required rate of flow. Single common partitions 22 can be used or a partition can be used at the end of each adjacent header segment. Although the upper and lower headers are shown made of half pipes, any structural shape that would serve the same purpose of forming a header can be used.

Conduit 28 communicates with the lower header ring segment 25A and is used to supply a cooling liquid. Conduit 30 communicates with the upper header ring segment 25Z, adjacent to segment 25A, and is used to remove hot cooling liquid from the system. There is no liquid flow communication between segments 25Z and 25A so that segment 25A constitutes the initial segment, and segment 25Z constitutes the terminal segment, of the cooling structure. It should be realized that more than one inlet conduit, and more than one outlet conduit, can be used. In addition, the segments 25A, 25B, etc. can be grouped together in assemblies of two, three or more and each group can be provided with its own inlet and outlet conduits 28 and 30.

Figure 3:
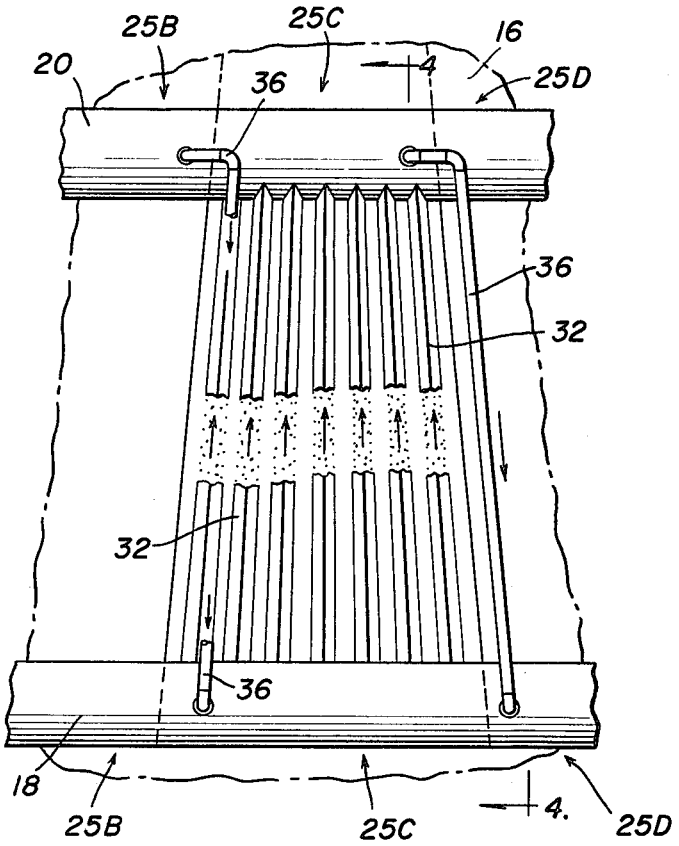
FIG. 3 is an enlarged elevational view of the cooling passage arrangement shown in FIGS. 1 and 2.
Figure 4:
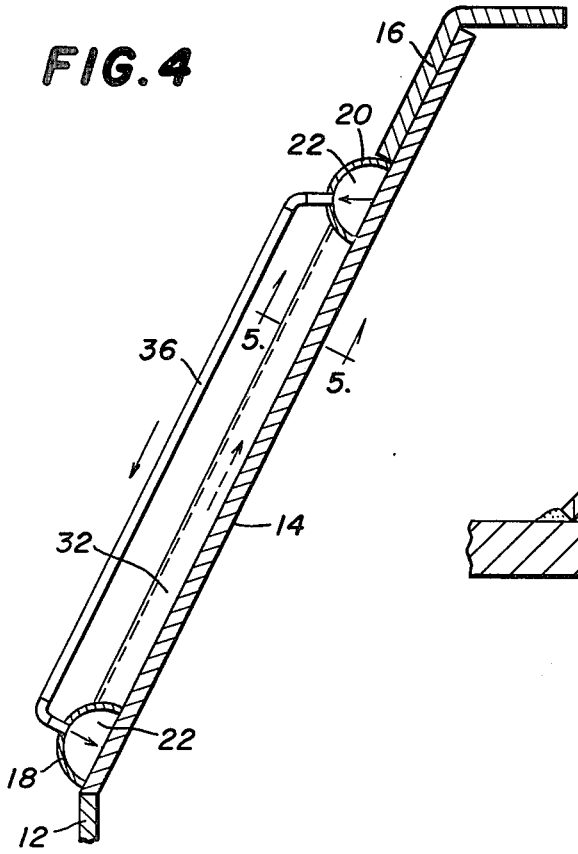
FIG. 4 is a sectional view taken along the line 4—4 of FIG. 3.

Each segment 25A, 25B, etc. has a plurality of metal walled passages extending between, and in communication with, the lower and upper headers. For convenience, the metal walled passages are shown in FIGS. 1 to 3 only for segment 25C since the other segments are similar.

Figure 5:
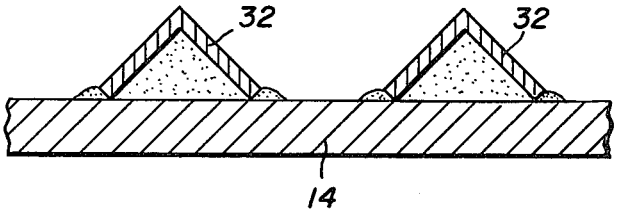
FIG. 5 is a sectional view taken along the line 5—5 of FIG. 4.

The metal walled passages of segment 25C are formed by a plurality of metal angles 32 (FIGS. 1 to 5) of identical size and shape welded to the top surface of conical portion 14 along element lines of the conical surface. The lower ends of angles 32 are in communication with that portion of lower header 18, and the upper ends of angles 32 are in communication with that portion of upper header 20, serving segment 25C. In FIG. 5, the distance between the angles will be determined so that uniform cooling of the cone will be achieved. A metal pipe 36 (FIGS. 1 to 4) extends from the top header portion of segment 25B to the lower header portion of adjacent segment 25C. A similar pipe 36 extends from the top header portion of segment 25C to the lower header portion of segment 25D. Similar pipes 36 extend between the upper header and lower header portions between adjacent segments 25C–25D, 25D–25E, etc. until segment 25Z is reached. No pipe 36 extends between segments 25Z–25A since it would defeat or reduce removal of hot cooling liquid from the system by conduit 30. The pipes 36 draw off the cooling fluid from the top header portion of each segment 25A, 25B, etc. and deliver it to an adjacent segment. In this way there is always an upward flow of liquid in the passages and no counterflow of vapor in the passages. Furthermore, even though the flow of liquid in pipes 36 is downwards, no counterflow of vapor is likely since the pipes are maintained out of contact with the vessel and have air space therebetween which permits the liquid to cool and vapor to condense.

Figure 6:
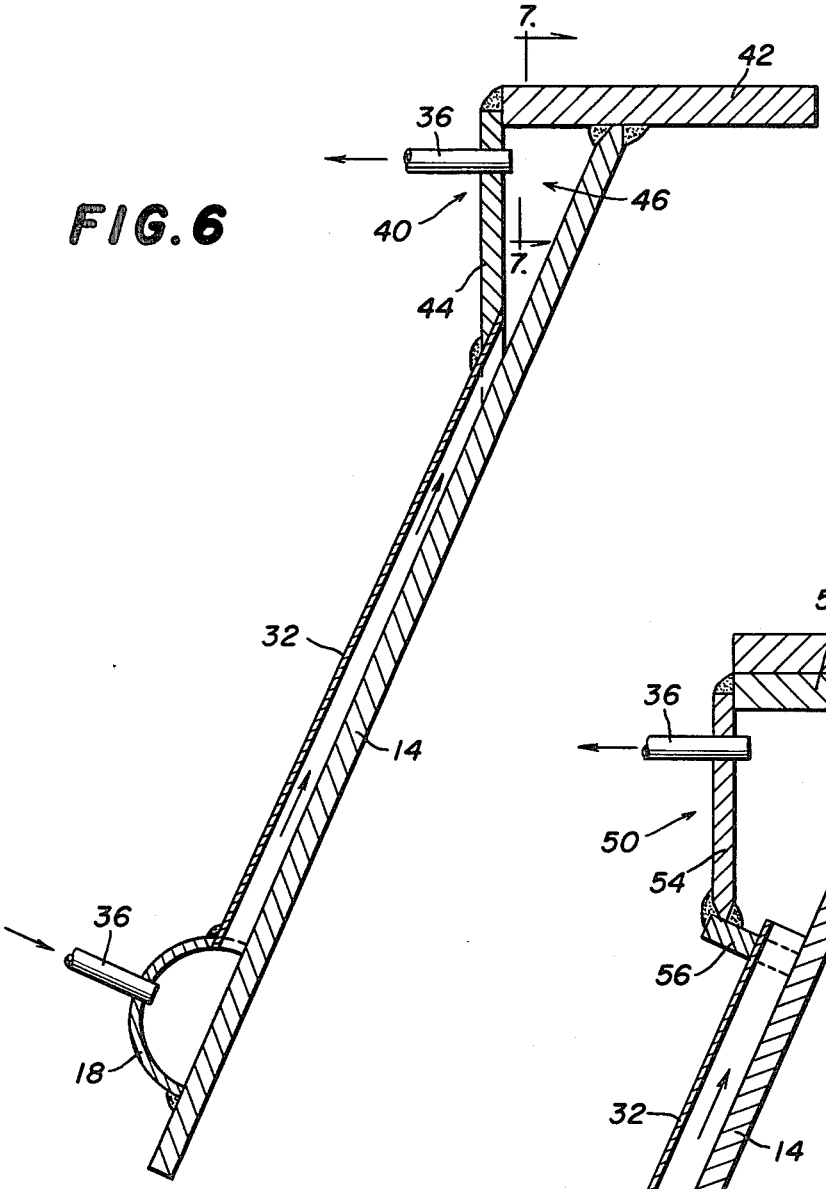
FIG. 6 is a sectional view like FIG. 4 but with the upper header located at the vessel mouth.
Figure 7:
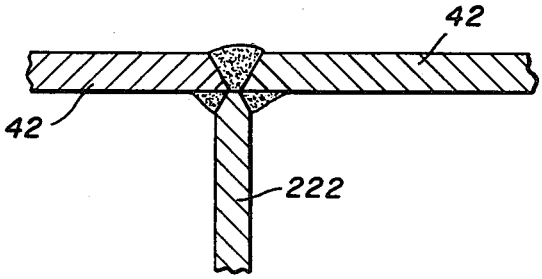
FIG. 7 is a sectional view taken along the line 7—7 of FIG. 6.

A second embodiment of the invention is shown in FIGS. 6 and 7. In this embodiment, the upper header 40 is formed in part by flat lip ring 42 welded to the upper edge of conical portion 14 and extending outwardly therefrom. Vertical circular plate 44 extends downwardly from the outer edge of lip ring 42 into contact with conical portion 14, and the top surfaces of angles 32, to which it is welded thereby enclosing a liquid header channel or space 46. It should be understood that upper header 40 has a partition at each segment end.

A common partition plate 222 (FIG. 7) is located between upper header segments 24A, 24B, etc. The embodiment of FIG. 6 is particularly useful for cooling the vessel mouth since the upper header 40 is located adjoining it. Having the upper header at the vessel mouth (near the lip ring) provides an additional function for this scheme of cooling the lip ring area in addition to cooling of the top cone.

Figure 8:
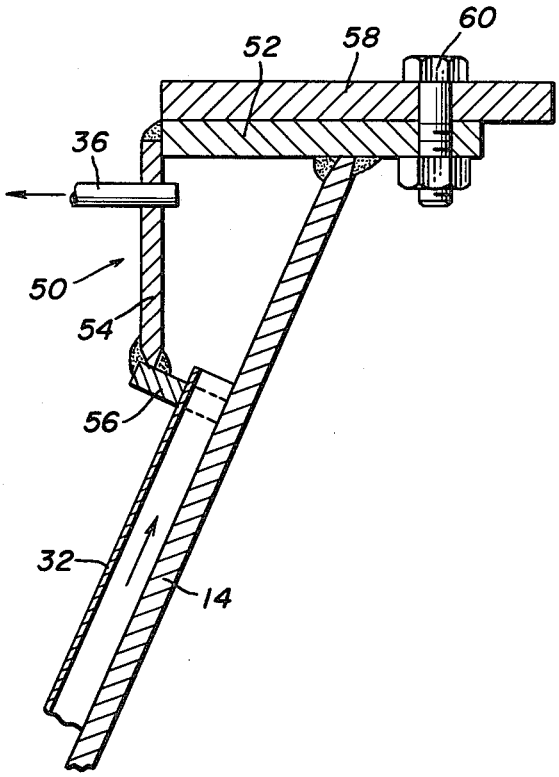
FIG. 8 is like FIG. 6 but shows an additional type of upper header.

FIG. 8 illustrates a further example of the invention in which an upper header 50 is positioned adjoining the vessel mouth. Upper header 50 is formed in part by lip ring plate 52 welded to the top edge of conical portion 14 and projecting outwardly therefrom. Vertical circular plate 54 is welded at its top edge to the periphery of ring plate 52. Inwardly sloping plate 56 extends from the lower edge of plate 54 to the top surfaces of angles 32 and the surface of conical portion 14, thereby completing the upper header 50. A projecting plate 58 is secured by bolts 60 to the top of ring plate 52.

Although not shown in the drawings, a slag shield plate would be positioned over each pipe 36 to protect it against damage.

The foregoing detailed description has been given for clearness of understanding only, and no unnecessary limitations should be understood therefrom, as modifications will be obvious to those skilled in the art.

What is claimed is:

1. In a molten metal refining vessel having an internally insulated metal shell, said shell having a bottom, wall and top conical portion, the improvement comprising:

a plurality of cooling liquid metal walled heat-exchange passages, adjacent the top conical portion exterior surface, substantially aligned like element lines of a conical surface;

means to supply a cooling liquid so that it flows upwardly in all of the passages; and means to withdraw cooling liquid, from the upper end of all the passages, away from the surface which is being cooled.

2. A vessel according to claim 1 in which the means to supply cooling liquid to the passages supplies the cooling liquid to the lower end of the passages.

3. A vessel according to claim 1 in which the means for withdrawing cooling liquid from the upper end of the passages prevents it from flowing downwardly in the passages.

4. A vessel according to claim 1 in which:

the passage lower ends communicate with an inlet header;

the means to supply a cooling liquid communicates with the inlet header;

the passage upper ends communicate with an outlet header; and the means to withdraw cooling liquid communicates with the outlet header.

5. A vessel according to claim 1 in which:

the passages are arranged in a plurality of side-by-side assemblies;

each assembly comprises a group of adjacent passages with an inlet header communicating with the passage lower ends and with an outlet header communicating with the passage upper ends;

the means to supply a cooling liquid communicates with the inlet header of a first assembly;

the means to withdraw cooling liquid communicates with the outlet header of a terminal assembly; and each pair of adjacent assemblies has a liquid conduit communicating with the outlet header of the upstream assembly, and with the inlet header of the downstream assembly, of the pair.

6. A vessel according to claim 5 in which the liquid conduit is spaced above, so as to be out of contact with, the vessel conical top surface, and the metal walls of the passages are in contact with the vessel conical top surface.

7. A vessel according to claim 6 in which the metal walled passages include, as part of the passage wall, a surface strip of the conical top.

8. A vessel according to claim 7 in which the passages are defined by a structural shape, the longitudinal edges of which are welded to the conical top surface.

9. A vessel according to claim 8 in which the structural shape is an angle.

10. A vessel according to claim 8 in which the structural shape is a channel.

11. A vessel according to claim 6 in which the outlet header comprises an area adjacent to a lip ring, along the upper end of the conical portion, for cooling of the lip ring area.

* * * * *

UNITED STATES PATENT AND TRADEMARK OFFICE

CERTIFICATE OF CORRECTION

PATENT NO. : 4,278,241

DATED : July 14, 1981

INVENTOR(S) : Fahim E. Shadid

It is certified that error appears in the above-identified patent and that said Letters Patent are hereby corrected as shown below:

Column 6, line 11, change "6" to --5--.

Signed and Sealed this

*Twenty-second* Day of *September 1981*

[SEAL]

*Attest:*

GERALD J. MOSSINGHOFF

*Attesting Officer*

*Commissioner of Patents and Trademarks*